US006673320B1

(12) United States Patent
Tosa et al.

(10) Patent No.: US 6,673,320 B1
(45) Date of Patent: Jan. 6, 2004

(54) EXHAUST CONVERTER

(75) Inventors: Shinichi Tosa, Utsunomiya (JP); Junichi Nakade, Kanuma (JP); Yasushi Kageyama, Hamamatsu (JP); Kozo Suganuma, Hamamatsu (JP)

(73) Assignees: Honda Giken Kogyo Kabushiki Kaisha, Tokyo (JP); Kabushiki Kaisha Yutaka Giken, Shizuoka-ken (JP)

( * ) Notice: Subject to any disclaimer, the term of this patent is extended or adjusted under 35 U.S.C. 154(b) by 0 days.

(21) Appl. No.: 09/500,915

(22) Filed: Feb. 9, 2000

(30) Foreign Application Priority Data

Apr. 9, 1999 (JP) ..... 11-102118

(51) Int. Cl.[7] ..... F01N 3/28; F01N 7/14
(52) U.S. Cl. ..... 422/179; 422/177; 422/180
(58) Field of Search ..... 422/174, 177, 422/179, 180; 502/527.12–527.17; 29/890; 392/485; 428/921

(56) References Cited

U.S. PATENT DOCUMENTS 4,142,864 A * 3/1979 Rosynsky et al. ..... 422/179
5,526,462 A * 6/1996 Kondo et al. ..... 392/485
5,866,079 A * 2/1999 Machida et al. ..... 422/179
5,943,771 A * 8/1999 Schmitt ..... 29/890
6,217,832 B1 * 4/2001 Betta et al. ..... 422/179
6,299,843 B1 * 10/2001 Locker et al. ..... 422/179
2001/0048903 A1 * 12/2001 Sanocki et al. ..... 422/179
2002/0021989 A1 * 2/2002 Abe ..... 422/174

* cited by examiner

*Primary Examiner*—Hien Tran
(74) *Attorney, Agent, or Firm*—Townsend & Banta

(57) ABSTRACT

In an exhaust converter, where a casing is made by fastening and welding a cylindrical metal plate wrapped on an outer periphery of a supporting mat that is wrapped on an outer peripheral surface of a catalyst carrier, recovering means is formed at either or both of the supporting mat and the casing for recovering positional shifts of the supporting mat, thereby preventing positional shifts of the supporting mat in conjunction with fastening work of the metal plate from occurring. Such recovering means can be structured by a recess formed at an end of the casing, plural spaces formed of a crank shaped supporting mat, or a space formed at an overlapped portion at which each end of the casing is overlapped to each other.

2 Claims, 5 Drawing Sheets

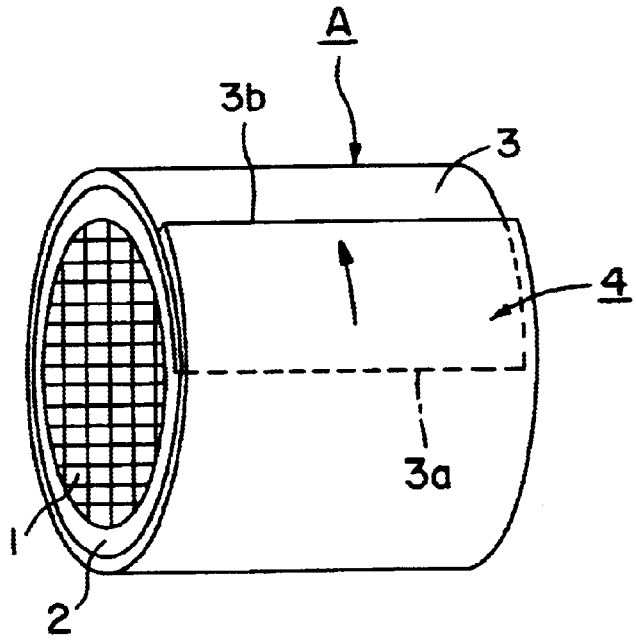
FIG. 1
FIG. 2(a)
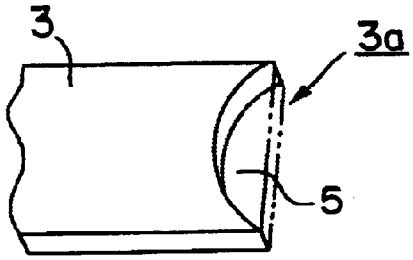
FIG. 2(b)
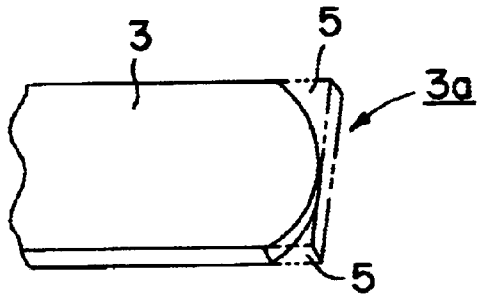
FIG. 2(c)
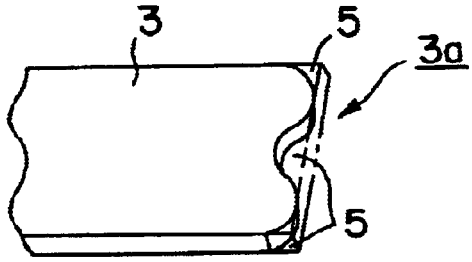

EXHAUST CONVERTER

BACKGROUND OF THE INVENTION

1. Field of the Invention

This invention relates to an exhaust converter structured with a catalyst carrier wrapped with a supporting mat and a casing in which the catalyst carrier is incorporated and, more particularly, to an exhaust converter so constituted to recover positional shifts of the supporting mat when the supporting mat is positionally shifted.

2. Description of Related Art

Exhaust converters have a function to convert harmful gases such as hydrocarbon or carbon monoxide contained in exhaust gas of engines to stable compounds such as steam or carbon gas and to discharge the converted gases to the open air.

Such an exhaust converter, as shown in FIG. 8, holds a catalyst containing noble metals for purifying exhaust gas with a carrier 51 made of a ceramic having a honeycomb structure. A supporting mat 52 made of a heat insulator having an elasticity is wrapped over the carrier 51. A cylindrical shaped metal plate 53 is wrapped on an outer periphery of the supporting mat 52 and fastened tightly to support the carrier 51 in operating compression force to the supporting mat 52, and subsequently, the cylindrical shaped metal plate 53 is welded to form a casing, thereby maintaining a high gas-sealing property.

With the above exhaust converter, when a cylindrical shaped metal plate 53 is formed having a constant radius of curvature, spaces between the carrier and the metal plate become different between an overlapped portion 54 and other portions, so that uneven load is exerted to the carrier. The carrier therefore may be broken by exertion of uneven force.

To solve the above problem, a method for manufacturing a catalyst converter disclosed in Japanese Unexamined Patent Publication (KOKAI) Heisei No. 10-121,953 has been proposed. In this art, the converter includes a pipe-shaped metal shell having a constant radius of curvature, and an overlapped portion is structured to have the same radius of curvature as the outer periphery of the shell. With this art, where the shell is wrapped over the outer periphery of the supporting mat, no spot load occurs along the overlapped portion at the shell.

The supporting mat 52 wrapped on the carrier is, as shown in FIG. 9, formed with projections 52*a* formed at each end in a longitudinal direction to face with one another, and the mat 52 has a length that each end does not overlap with each other when the mat is wrapped on the carrier.

However, when the metal plate is wrapped and fastened on the outer periphery of the supporting mat wrapped on the carrier, the metal plate moves in a circumferential direction, thereby reducing the diameter of the plate. According to the movement of the metal plate, the supporting mat is shifted to exist unevenly on a side and gathers at the overlapped portion of the metal plate. Consequently, a concentrated load is exerted to a position corresponding to the overlapped portion of the metal plate of the carrier, thereby rendering possibly the carrier broken down.

Such a problem occurs regardless whether the space between the catalyst converter and the cylindrical shaped metal plate is constant or not, and occurs according to the movement of the metal plate in the circumferential direction which occurs at a time that the metal plate is tightly fastened, so that the art disclosed in the above Publication will not solve the problem.

It is an object of the invention to provide an exhaust converter for preventing the carrier from broken down upon preventing the carrier from receiving a concentrated load by recovering, with recovering means, positional shifts of the supporting mat which occur when the metal plate wrapped over the outer periphery of the supporting mat is fastened tightly.

SUMMARY OF THE INVENTION

An exhaust converter according to the invention includes a catalyst carrier made of a ceramic material, a supporting mat wrapped on an outer periphery of the catalyst carrier, a casing formed in a cylindrical shape incorporating therein the catalyst carrier wrapped with the supporting mat, and recovering means formed at either or both of the supporting mat and the casing for recovering positional shifts of the supporting mat.

The above exhaust converter can recover positional shifts occurring according to fastening of the casing since the above exhaust converter is formed with the recovering means formed at the supporting mat or at the casing or at both of the supporting mat or the casing for recovering positional shifts of the supporting mat. Therefore, the positional shifts do not operate to the catalyst carrier as to give concentrated loads to the carrier, so that the catalyst carrier will never be broken down.

With the above exhaust converter, it is preferable to provide a friction reducing means placed between an inner surface of the casing and the supporting mat for reducing friction between the inner surface and the supporting mat. By providing the friction reducing means between the inner surface of the casing and the supporting mat, the movement of the supporting mat in association with the casing when the casing is fastened tightly can be reduced effectively. Therefore, the shifts occurring at the supporting mat can be reduced.

BRIEF DESCRIPTION OF THE DRAWINGS

The above and other objects and features of the invention are apparent to those skilled in the art from the following preferred embodiments thereof when considered in conjunction with the accompanied drawings, in which:

FIG. 1 is a schematic perspective view showing an exhaust converter according to the invention;

FIGS. 2(*a*) to 2(*c*) are schematic perspective views showing respective recovering means in the case where the respective recovering means are formed on the casing;

DESCRIPTION OF PREFERRED EMBODIMENTS

Figure 3A:
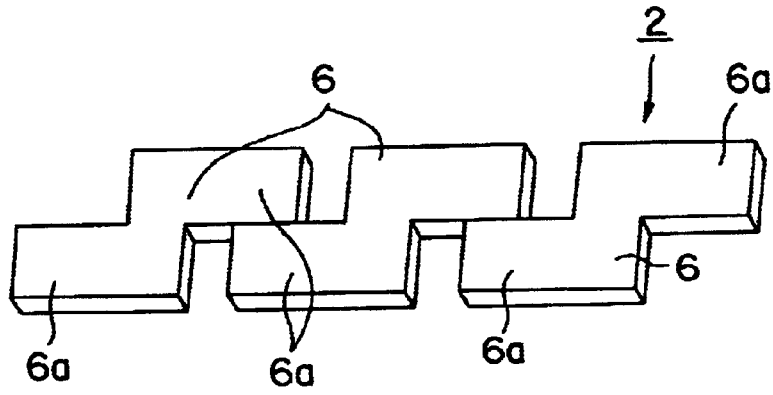
FIGS. 3(*a*) to 3(*c*) are schematic perspective views showing respective recovering means in the case where the respective recovering means are formed at the supporting mat.
Figure 3B:
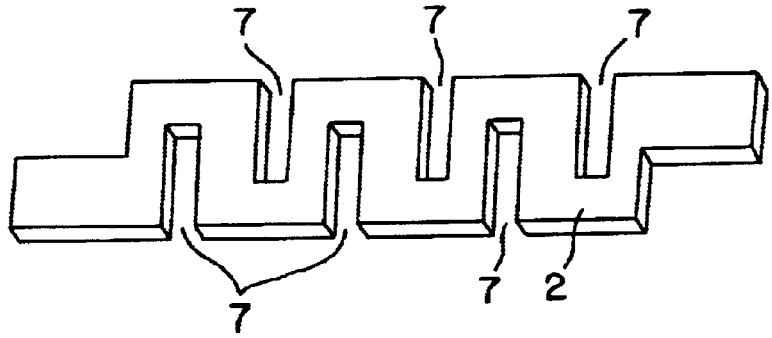
Figure 3C:
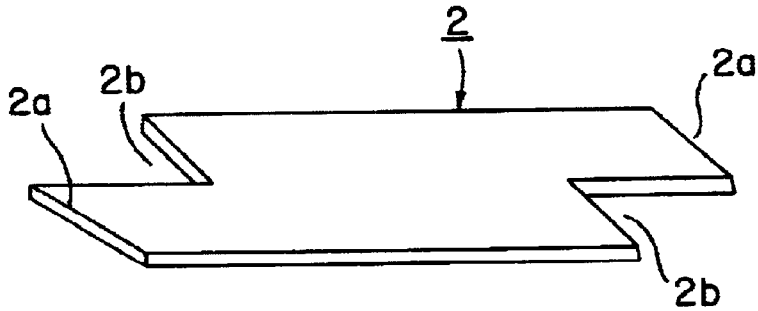
Figure 4C:
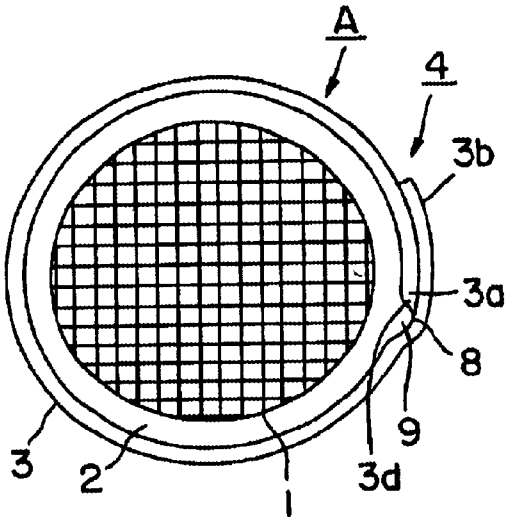
FIGS. 4(*a*) to 4(*c*) are schematic side views showing other respective recovering means in the case where the respective recovering means are formed at the respective overlapped portions.
Figure 4B:
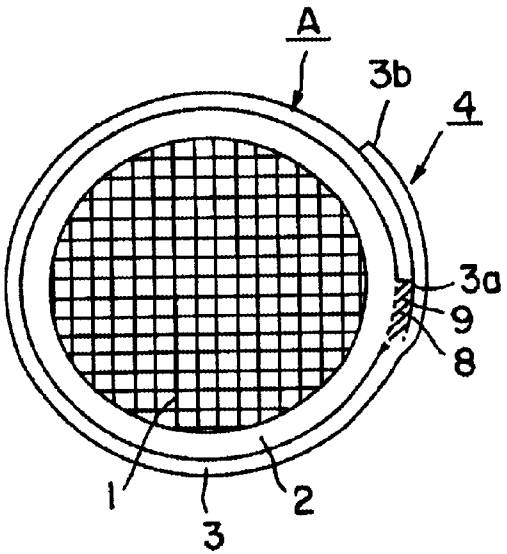
Figure 4A:
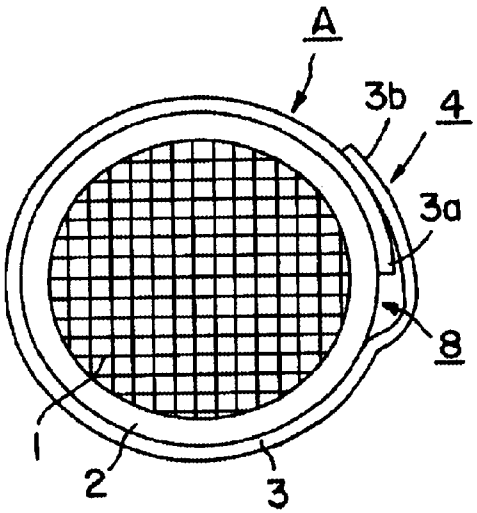
Figure 5:
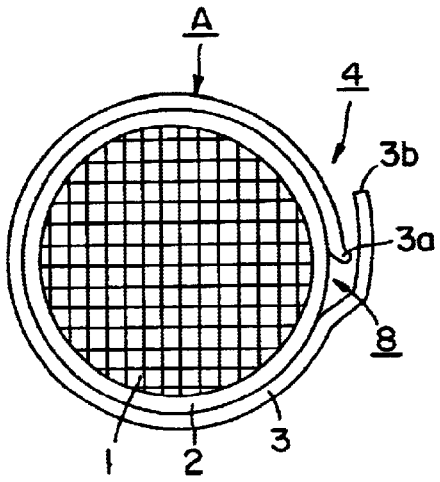
FIG. 5 is a schematic side view showing the exhaust converter in the case where the lower end at the overlapped portion of the casing is curved upward.
Figure 6:
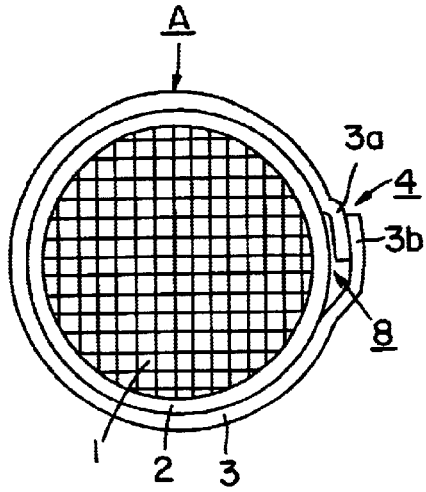
FIG. 6 is a schematic side view showing the exhaust converter in the case where each end at the overlapped portion of the casing is formed in a stepwise shape.
Figure 7:
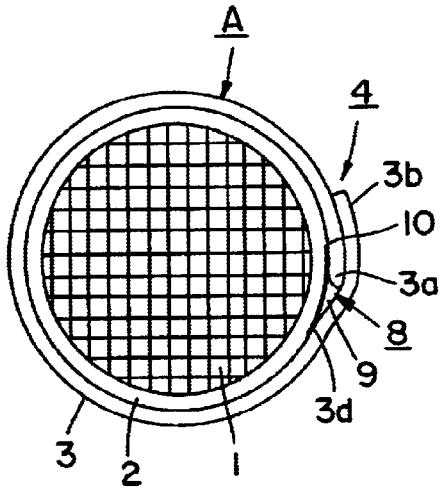
FIG. 7 is a schematic side view showing the exhaust converter in the case where a shim plate serving as a friction reducing mean is placed between the supporting mat and the casing.
Figure 8:
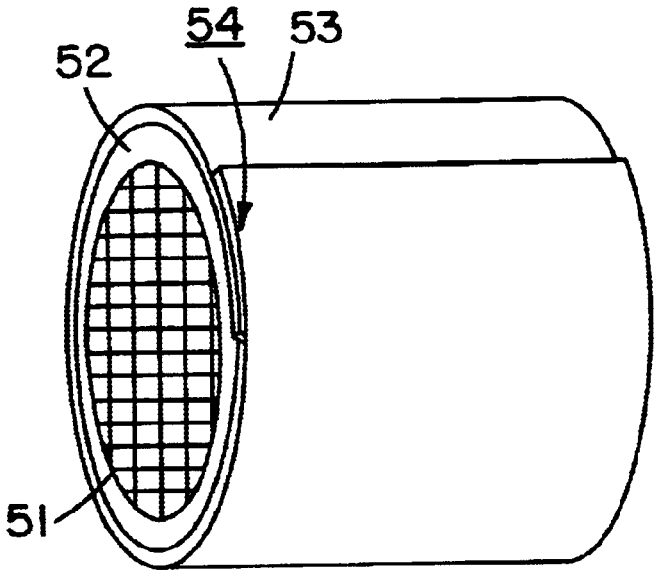
FIG. 8 PRIOR ART
FIG. 8 is an illustration showing a conventional exhaust converter.
Figure 9:
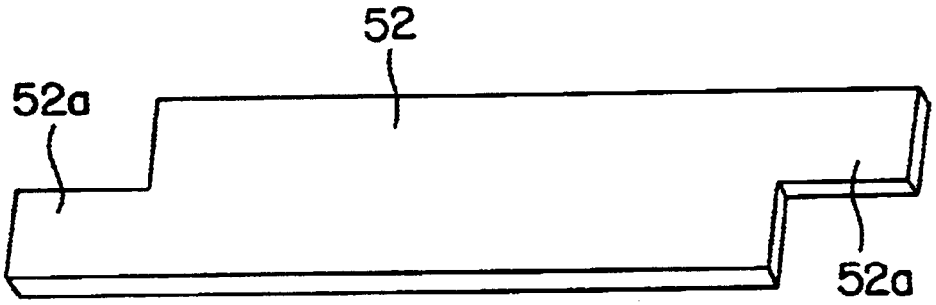
FIG. 9 PRIOR ART
FIG. 9 is an illustration showing a supporting mat of the conventional exhaust converter.

Hereinafter, an embodiment of an exhaust converter according to the invention will be described in reference to the drawings. FIG. 1 is a schematic perspective view showing an exhaust converter according to the invention; FIGS. 2(*a*) to 2(*c*) are schematic perspective views showing respective recovering means in the case where the respective recovering means are formed on the casing; FIGS. 3(*a*) to 3(*c*) are schematic perspective views showing respective recovering means in the case where the respective recovering means are formed at the supporting mat; FIGS. 4(*a*) to 4(*c*) are schematic side views showing other respective recovering means in the case where the respective recovering means are formed at the respective overlapped portions; FIG. 5 is a schematic side view showing the exhaust converter in the case where the lower end at the overlapped portion of the casing is curved upward; FIG. 6 is a schematic side view showing the exhaust converter in the case where each end at the overlapped portion of the casing is formed in a stepwise shape; FIG. 7 is a schematic side view showing the exhaust converter in the case where a shim plate serving as a friction reducing mean is placed between the supporting mat and the casing.

First of all, a structural outline of an exhaust converter A is described with reference to FIG. 1. In FIG. 1, the exhaust converter A has a catalyst carrier I made of a ceramic having a honeycomb structure. A supporting mat 2 is wrapped on an outer periphery of the catalyst carrier 1. The exhaust converter has a casing 3 formed as a metal plate wrapped in a cylindrical shape on an outer periphery of the supporting mat 2.

The catalyst carrier 1 is made of a ceramic having a honeycomb structure and holds in advance a catalyst containing a noble metal or metals for purifying exhaust gas from an engine. The catalyst carrier 1 has a function to convert very unstable gases such as hydrocarbon or carbon monoxide harmful to human bodies contained in exhaust gas in contact with the carrier into stable substances such as water (or steam) or carbon gas and to discharge the converted gases.

The supporting mat 2 is disposed between the catalyst carrier 1 and the casing 3 and has a function to support the catalyst carrier 1 in a stable state in following expansions when the casing 3 is expanded due to heats contained in the exhaust gas. The supporting mat 2 is formed in having several conditions of, e.g., prescribed thickness, width, length, elasticity, thermal expansion rate, heat insulation property, and the like, and is wrapped on the outer peripheral surface of the catalyst carrier 1.

The casing 3 has a function to support the catalyst carrier 1 and the supporting mat 2 in keeping air-tightness of the catalyst carrier 1 and the supporting mat 2 and has a structure to prevent the exhaust gas discharged from the engine and supplied to the catalyst carrier 1 from leaking from the carrier 1.

The casing 3 is made from molding into the cylindrical shape a metal plate that has good heat resistance, predetermined strength, and good fabricating property, such as, e.g., a stainless steel plate. The casing 3 compresses the supporting mat 2 by tightly fastening the supporting mat 2 by wrapping on the outer periphery of the supporting mat 2. The casing 3 supports the catalyst carrier 1 in exerting force to the catalyst carrier 1 through the supporting mat 2 by restraining the metal plate upon welding an overlapped portion 4 where the diameter of the metal plate in the cylindrical shape reaches a predetermined amount.

Therefore, the overlapped portion 4 is formed by overlapping ends 3*a*, 3*b* in a longitudinal direction of the casing 3. In this embodiment, the end 3*a* constituting the overlapped portion 4 is placed on an inner side, or on a side in contact with the supporting mat 2, whereas the end 3*b* is placed on an outer side, or on a side overlapping on the outer periphery of the casing 3.

As for the steps manufacturing the exhaust converter A, where the supporting mat 2 is wrapped on the catalyst carrier 1, the cylindrical metal plate is wrapped on the outer periphery of the supporting mat 2 and fastened tightly. At that time, the end 3*b* is moved in an arrow direction (circumferential direction), thereby making smaller the diameter of the cylindrical portion. When the diameter of the cylindrical portion reaches a prescribed amount, the end 3*b* and the outer periphery of the cylindrical metal plate are welded and immobilized, and this makes the casing molded.

During fastening the cylindrical metal plate as thus described, positional shifts may occur at the supporting mat 2 in conjunction with the metal plate 2 in the arrow direction (in the circumferential direction). That is, the end 3*a* of the metal plate is made immobilized as not to move when the cylindrical metal plate is tightly fastened. Therefore, the supporting mat 2 positionally shifted according to fastening of the cylindrical metal plate is immobilized with respect to the end 3*a*, thereby gathering at a portion corresponding to the overlapped portion 4. Such positional shifts of the supporting mat 2 that gathered at the overlapped portion 4 exerts a large load locally to the catalyst carrier 1, thereby causing a breakdown. Accordingly, by providing recovering means, the positional shifts of the supporting mat 2 that gathering at the overlapped portion 4 can be recovered, thereby avoiding locally high loads to the catalyst carrier 1.

FIG. 2(*a*) to FIG. 2(*c*) are for describing some structures of the recovering means formed at the casing 3. In this embodiment, a recess 5 is formed at the end 3*a* of the casing 3, and the recess 5 is made to function as the recovering means.

That is, FIG. 2(*a*) shows a structure with the recess 5 that is indented at a middle portion more than at each end in the width direction at the end 3*a* of the casing 3. FIG. 2(*b*) shows a structure with the recess 5 that is indented at each end more than at a middle portion in the width direction at the end 3*a* of the casing 3. FIG. 2(*c*) shows a structure with the recess 5 that is indented at a middle portion and each end, respectively.

In this embodiment, the recess 5 as recovering means has contents defined by the thickness of the metal plate constituting the casing 3 and the area size of the recess 5. For example, the thickness of the metal plate constituting the casing 3 is not so large, and in this embodiment, the thickness is 1.5 mm. Accordingly, the positional shifts of the supporting mat 2, occurring according to fastening of the casing 3, can be recovered by setting the area size of the recess 5 in estimating the contents of the positional shifts of the supporting mat 2.

FIG. 3(*a*) to FIG. 3(*c*) are for describing structures in which the recovering means is formed at the supporting mat 2. FIG. 3(*a*) is for a recovering means formed of spaces formed between projections 6*a* when mat members 6 are assembled where the supporting mat 2 is formed from plural mat members (three sheets in this embodiment) having projections 6*a* on each end in the longitudinal direction.

With the supporting mat 2 thus structured, three sheet mat members 6 are wrapped on an outer peripheral surface of the catalyst carrier 1, and spaces are formed at connecting portions of the mat members 6 in extending in the circumferential direction. When the cylindrical metal plate is wrapped and tightly fastened on the outer periphery of the mat members 6, positional shifts of the mat members 6 occurring according to this fastening are escaped in and recovered at the spaces formed between the mat members 6, so that the shifts will not gather at the overlapped portion 4.

FIG. 3(*b*) is for describing a structure in which plural spaces 7 serving as the recovering means are formed in extending in the longitudinal direction by forming the supporting mat 2 in a crank shape. The supporting mat 2 thus structured places plural spaces 7 in the circumferential direction when wrapped on the outer peripheral surface of the catalyst carrier 1. Therefore, when the cylindrical metal plate is wrapped and tightly fastened on the outer periphery of the supporting mat 2, positional shifts of the supporting mat 2 occurring according to this fastening are escaped in and recovered at the spaces, so that the shifts will not gather at the overlapped portion 4.

FIG. 3(*c*) illustrates a structure in which a projection 2*a* of the supporting mat 2 is formed in a rectangular shape, and a cutout 2*b* in a retangular shape is thus formed at a corresponding portion. With the supporting mat 2 thus structured, when the supporting mat 2 is wrapped on the catalyst carrier 1, the line at which each end faces one another extends in a zigzag shape with respect to the overlapped portion 4.

Therefore, the facing line of the ends of the supporting mat 2 and the overlapped portion 4 of the casing 3 will never be the same to one another, and positional shifts of the supporting mat 2 occurring according to fastening of the casing 3 are escaped in and recovered at the faced section of the ends, so that the shifts will not gather at the overlapped portion 4.

FIG. 4(*a*) to FIG. 4(*c*) are for describing other structures in which respective recovering means are placed at a position corresponding to the overlapped portion 4 of the casing 3. As shown in FIG. 4(*a*), a space 8 serving as recovering means is formed at a position corresponding to the overlapped portion 4 of the casing 3. The space 8 has a size twice of the thickness of the metal plate in a radial direction before the metal plate is fastened tightly, and has a size adequately larger in a circumferential direction than a moving length of the metal plate in the circumferential direction when the metal plate is fastened.

Accordingly, as shown in FIG. 4(*b*), when the cylindrical metal plate is wrapped and fastened tightly on the outer periphery of the supporting mat 2 wrapped on the catalyst carrier 1, the space 8 is formed in having contents smaller than the contents shown in FIG. 4(*a*) at the overlapped portion 4. Positional shifts of the supporting mat 2 occurring according to fastening of the metal plate are escaped in the space 8 to form an expansion position 9. Consequently, positional shifts oft he supporting mat 2 will not exert any concentrated force to the catalyst carrier 1.

With the above structure, the end 3*a* of the casing 3 is preferably formed with a chamfered portion 3*d* as shown in FIG. 4(*c*). That is, because the end 3*a* corresponds to the space 8, the end 3*a* may contact with the supporting mat 2 to be escaped in the space 8. Where the end 3*a* has a keen edge, the edge may spike into the supporting mat 2, but the chamfered portion 3*d* prevents the supporting mat 2 from positionally shifting.

In the above embodiments, described are the cases where the recovering means for recovering the positional shifts of the supporting mat 2 is formed at the end 3*a* of the casing 3, where the recovering means is formed of the spaces formed at the supporting mat 2, and where the recovering means is formed at the overlapped portion of the ends 3*a*, 3*b* of the casing 3. However, the recovering means is not necessarily formed at either of the casing 3 and the supporting mat 2, but the recovering means can be formed in combination of those.

FIG. 5 is for describing another structure formed with a recovering means at a position corresponding to an overlapped portion of a casing 3. In FIG. 5, the end 3*a* of the casing 3 is formed in positively curving as to extend radially outward from the outer peripheral surface of the supporting mat 2. When the casing 3 is fastened tightly, even where positional shifts occur in conjunction with this fastening, the structure avoids the supporting mat 2 from receiving damages, and the end 3*a* is bent radially outward to enlarge the contents of the space 8.

FIG. 6 is for describing another structure formed with a recovering means at a position corresponding to an overlapped portion of a casing 3. In FIG. 6, ends 3*a*, 3*b* of the casing 3 have a stepwise form extending outward, so that the converter can have the space with larger contents. By using the space 8, the positional shifts of the supporting mat 2 occurring in conjunction with fastening of the casing 3 can be recovered.

FIG. 7 is for describing another structure in which a shim plate 10 serving as a friction reducing means is provided between the outer peripheral surface of the supporting mat 2 and the inner peripheral surface of the casing 3. This shim plate 10 reduces effectively positional shifts of the supporting mat 2 by holding the position of the supporting mat 2 notwithstanding of movements of the casing 3 occurring at a time of fastening where the casing 3 is fastened tightly in reducing the contact friction between the supporting mat 2 and the casing 3.

The shim plate 10 is preferably disposed at a position corresponding to the overlapped portion 4 of the casing 3. Where the shim plate 10 is placed at such a position, the supporting mat 2 will not be trapped at, e.g., the end 3*a* of the casing 3 when the casing 3 is fastened. Therefore, the structure can eliminate a beginning point for occurrence of positional shifts.

As the shim plate 10, it is advantageous to use a shim plate made of a very thinner plate having a function as a shim plate and made in having a smaller friction coefficient with respect to a material constituting the supporting mat 2 than that of the casing 3.

As a friction reducing means for reducing contact friction between the supporting mat 2 and the casing 3, it is not necessarily the shim plate 10. That is, a problem of the contact friction between the supporting mat 2 and the casing 3 can be raised only during a fastening stage of the casing 3 where the exhaust converter A is manufactured. Therefore, after the casing 3 is fastened, there would be no problem if the friction reducing means does not adversely affect the purification of the exhaust gas even where the friction reducing means remains inside.

As a friction reducing means, useful is a paper tape. In this case, after the supporting mat 2 is wrapped on the outer peripheral surface of the catalyst carrier 1, a paper tape is wrapped on an outer peripheral surface of the supporting mat 2, thereby isolating contact of the supporting mat 2 entirely or partially from the casing 3. Accordingly, the exhaust converter can reduce friction coefficient in rendering the paper tape in contact with the casing 3.

Other papers and cloths, even other than the paper tape, can be used so long as those can be in contact with the casing 3 with a friction coefficient smaller than that between the supporting mat 2 and the casing 3.

It is also effective to arrange the direction of the fabric constituting the supporting mat 2 as a friction reducing means in a circumferential direction of the catalyst carrier. By using such a supporting mat 2 having the arranged fabric directional property, the friction coefficient can be reduced even where the casing 3 is tightly fastened, thereby enabling positional shifts to be reduced.

It is to be noted that the above recovering means and friction reducing means are not necessarily used solely, but can be used in combination to bring larger effects.

According to the exhaust converter of the invention, as described above, since a recovering means is placed at either or both of the supporting mat and the casing, positional shifts of the supporting mat, occurring in conjunction with fastening of the casing, can be recovered at the recovering means when the casing is made by fastening and welding a metal plate where the cylindrical metal plate is wrapped on the outer periphery of the supporting mat that is wrapped on the outer peripheral surface of the catalyst carrier. Therefore, the positional shifts of the supporting mat will not operate to exert a load in a concentrated manner to the catalyst carrier, so that the catalyst carrier is never broken down.

By providing such a reducing means, positional shifts of the supporting mat in conjunction with fastening when the casing is fastened can be reduced, so that a further average load can be exerted to the catalyst carrier when used concurrently with the recovering means.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but defined claims set forth below.

What is claimed is:

1. An exhaust converter comprising:

a catalyst carrier made of ceramic material, said catalyst carrier having an inner periphery and an outer periphery;

a supporting mat having an outer peripheral surface wrapped around the outer periphery of the catalyst carrier, the supporting mat being made of a plurality of subdivided mats which are connected with each other by projections, a recovering means comprising at least one space provided between the projections extending at a respective end of the supporting mat;

a metal casing having a first end and a second end formed in a cylindrical shape by overlapping said first and second end at an overlapped portion, said metal casing encapsulating the catalyst carrier wrapped in the supporting mat; and a space formed between the supporting mat and the overlapped portion of the metal casing, functioning so as to allow for recovery of positional shifts of the supporting mat.

2. An exhaust converter comprising:

a catalyst carrier made of ceramic material, said catalyst carrier having an inner periphery and an outer periphery;

a supporting mat having an outer peripheral surface wrapped around the outer periphery of the catalyst carrier;

a metal casing having a first end and a second end formed in a cylindrical shape by overlapping said first and second end at an overlapped portion, said metal casing encapsulating the catalyst carrier wrapped in the supporting mat;

a space formed between the supporting mat and the overlapped portion of the metal casing, functioning so as to allow for recovery of positional shifts of the supporting mat, and a shim plate having a friction coefficient smaller than that of the casing for reducing contact frictions between an inner surface of the casing and the mat, said shim plate positioned adjacent said overlapped portion of said metal casing so as to reduce positional shifts of the supporting mat by maintaining said supporting mat in position.

* * * * *